United States Patent [19]

Schempp

[11] 4,218,049

[45] Aug. 19, 1980

[54] METALLURGICAL VESSEL

[75] Inventor: Eberhard G. Schempp, Pittsburgh, Pa.

[73] Assignee: Pennsylvania Engineering Corporation, Pittsburgh, Pa.

[21] Appl. No.: 925,545

[22] Filed: Jul. 17, 1978

[51] Int. Cl.[2] ..... C21C 5/50

[52] U.S. Cl. ..... 266/243; 266/245

[58] Field of Search ..... 75/60; 266/243–248

[56] References Cited

U.S. PATENT DOCUMENTS

| | | | |
|---|---|---|---|
| 3,771,777 | 11/1973 | Fisher | 266/245 |
| 3,804,393 | 4/1974 | Maurice | 266/245 |
| 3,844,768 | 10/1974 | Leroy | 75/60 |

*Primary Examiner*—P. D. Rosenberg

[57] ABSTRACT

A metallurgical vessel has releasably coupled, semicylindrical upper and lower sections arranged such that the axis of revolution of one section lies in a plane normal relative to the rotational axis of the other. The dimension of each section in the axial direction being the same as the dimension of the other section in the direction normal to the axis. The vessel is mounted for rotation about the axis of the lower section and an elongate charging mouth is formed in the upper section and is arranged with its major axis parallel to the axis of the lower section. A plurality of tuyeres extend through the lower section of the vessel and each tuyere includes a first tuyere pipe for injecting oxygen beneath the level of molten metal within the vessel, a second tuyere pipe disposed in surrounding relation to the oxygen pipe for injecting powdered materials entrained in a nonoxidizing gas and a third pipe surrounding the second pipe for injecting a hydrocarbon shielding fluid. The vessel is mounted for rotaton about the axis of the lower sections by means of a pair of rings.

9 Claims, 5 Drawing Figures

METALLURGICAL VESSEL

BACKGROUND OF THE INVENTION

Converter type vessels of the Q-BOP and BOF types generally include a pear-shaped vessel open at its upper end to receive a metallic charge. Such vessels are normally mounted on a trunnion ring having trunnion pins supported by bearings for pivotal movement about a generally horizontal axis. The drive for pivoting vessels of this type typically includes a bull gear mounted on one of the trunnion pins and coupled by pinion gears to one or more drive motors. Such trunnion ring pinion supports are relatively complicated and expensive to fabricate and maintain.

Converter vessels of the Q-BOP type commonly include a removable bottom having a plurality of oxygen tuyere pipes each of which is surrounded by a second pipe for injecting a hydrocarbon shielding fluid in surrounding relation to the oxygen for the purpose of prolonging the life of the tuyeres and the surrounding refractory material. Notwithstanding the use of hydrocarbon shielding fluid, however, the bottom refractories and tuyeres wear at a substantially faster rate than the refractory material in the remaining portions of the vessel. For this reason, it is necessary to periodically replace Q-BOP vessel bottoms and their associated tuyeres several times during the life of the refractory in the upper portion of the vessel. The replacement of Q-BOP vessel bottoms requires that the vessel be out of service for substantial periods of time.

The treatment of ferrous metal in Q-BOP vessels not only involves the delivery of oxygen and a hydrocarbon shielding fluid but other gases such as, for example, nitrogen, air and argon and solid materials such as lime, burnt lime, fluorspar, carbon, iron oxide and the like. The solid materials are commonly entrained in nitrogen, argon or the oxygen and delivered through the oxygen tuyere pipe. Because of the tendency of such powdered material to coat the lining of the gas delivery system, the use of readily oxidizable desulfurizing agents such as calcium and magnesium is precluded.

SUMMARY OF THE INVENTION

This invention relates to metallurgical vessels wherein relatively pure oxygen is injected beneath the level of molten metal and a method of operating the same.

An object of the invention is to provide a new and improved bottom blown metallurgical vessel.

Another object of the invention is to provide a pivotally mounted bottom blown converter vessel which does not employ trunnion pin supports.

Yet another object of the invention is to provide a bottom blown converter wherein tuyere and bottom refractory replacement can be accomplished without substantial periods of vessel inactivity.

A still further object of the invention is to provide a bottom blown converter vessel wherein readily oxidizable desulfurizing agents may be employed.

These and other objects and advantages of the present invention will become more apparent from the detailed description thereof taken with the accompanying drawings.

DESCRIPTION OF THE PREFERRED EMBODIMENT

Figure 1:
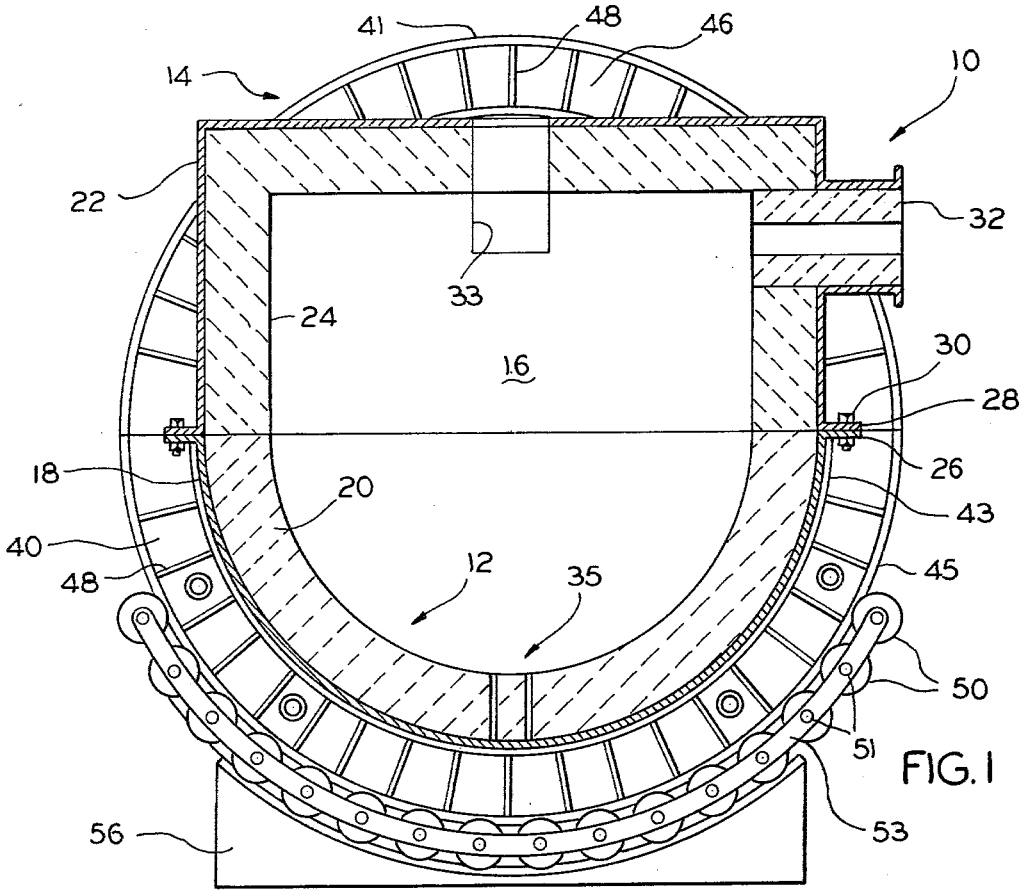
FIG. 1 is a side elevational view, with parts broken away, of the vessel according to the preferred embodiment of the present invention.
Figure 3:
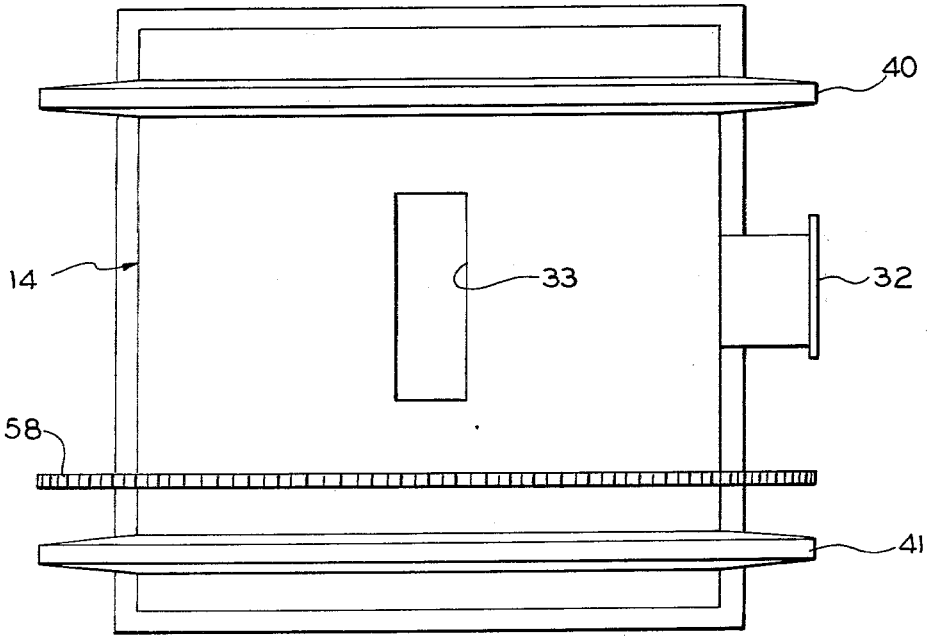
FIG. 3 is a top plane view of the vessel shown in FIG. 1.
Figure 2:
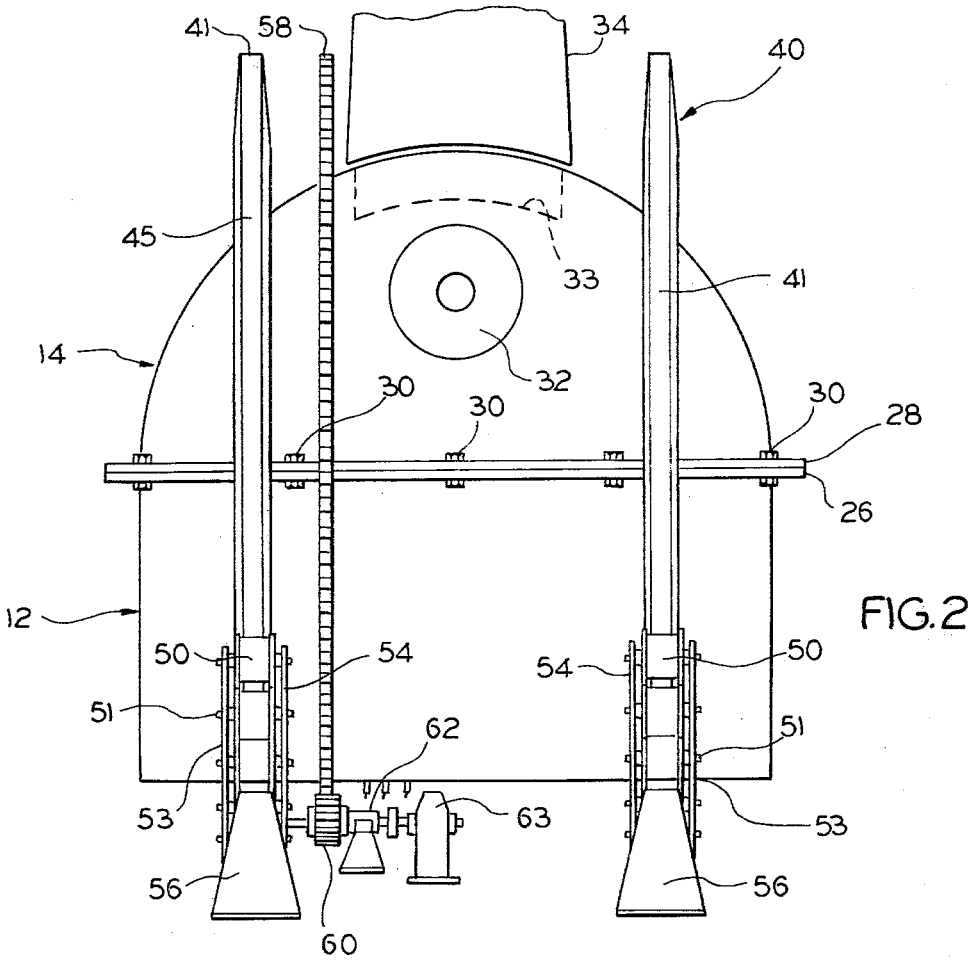
FIG. 2 is a front view of the vessel illustrated in FIG. 1.

The metallurgical vessel illustrated in FIGS. 1–3 includes upper and lower hollow semicylindrical sections 12 and 14, respectively, which are arranged with their axes of revolution disposed normally one to the other. The length of each of the sections 12 and 14 in a direction parallel to its axis of revolution is equal to the diameter of the cylindrical section of the other to define peripheral margins which are registrable so that when the sections are mated, a hollow chamber 16 is defined with the arcuate surface of each section tangential to the generally parallel end surfaces of the other. The upper and lower portions of the chamber 16 are, therefore, oppositely curved and generally square in plan view as shown in FIG. 3.

The lower section 12 includes a metallic shell 18 and a refractory lining 20 and the upper section 14 similarly includes a metallic shell 22 and a refractory lining 24. In addition, a plurality of tuyeres 25 extend through the shell 18 and lining 20 of the lower section for injecting fluids below the level of metal therein. The lower section 12 has a rectangular flange 26 extending around its upper periphery and which is registrable with a similar flange 28 which surrounds the lower periphery of upper section 14. The sections 12 and 14 are joined at their flanges 26 and 28 by bolts 30 which extend through suitable aligned openings in each.

A tap hole 32 extends through one side of the upper section lining 22 and adjacent the crown thereof. Also, a central charging mouth 23 is formed in the upper portion 14. While mouth 23 may have any convenient shape, it is shown in the illustrated embodiment to be generally rectangular in planar view and oriented with its major axis lying in a plane generally perpendicular to the pivotal axis of vessel portion 22. A smoke hood 34 may be located above the vessel 10 and is movable vertically by any conventional means (not shown). As those skilled in the art will appreciate, hood 34 is disposed above the mouth 33 during normal converter operation to collect off-gases and is connected to a cleaning system (not shown). When the vessel is to be tilted for charging, tapping or deslagging, the hood 34 is elevated to permit free pivotal movement of the vessel.

A pair of rings 40 and 41 are affixed in surrounding relation to the vessel 10 and adjacent the opposite ends thereof and in concentric relation to the axis of the lower section 12. Each of the rings 40 and 41 consists of an inner band 43 suitably secured to the metallic shells 18 and 24 of sections 12 and 14 and an outer annular band member 45 which is retained in spaced relation to the band 43 by means of a series of spacer plates 46 and 48 which are rigidly secured between the bands 43 and 45. The rings 40 and 41 are mounted on antifriction supports each of which includes a plurality of rollers 50 which are rotatably mounted on shafts 51 extending between a pair of arcuate side plates 53 and 54. The rollers 50 are supported upon and are in rolling engagement with a suitably supported arcuate base member 56. The vessel 10 may be rocked about the axis of the roller section 12 by means of an arcuate rack 58 affixed to vessel 10 adjacent ring 41 and in concentric relation therewith. Rack 58 is driven by a pinion gear 60 which is driven by means of a speed reducing mechanism 62 and a reversible motor 63. It will be appreciated that when motor 63 is energized, the vessel 10 will be rotating through the desired angle and direction upon suitable control of motor 63. It will also be appreciated that each of the rings 40 and 41 and the rack 58 will each be formed in two semicircular parts along the parting line of vessel portions 12 and 14 so that these portions may be separated.

Figure 4:
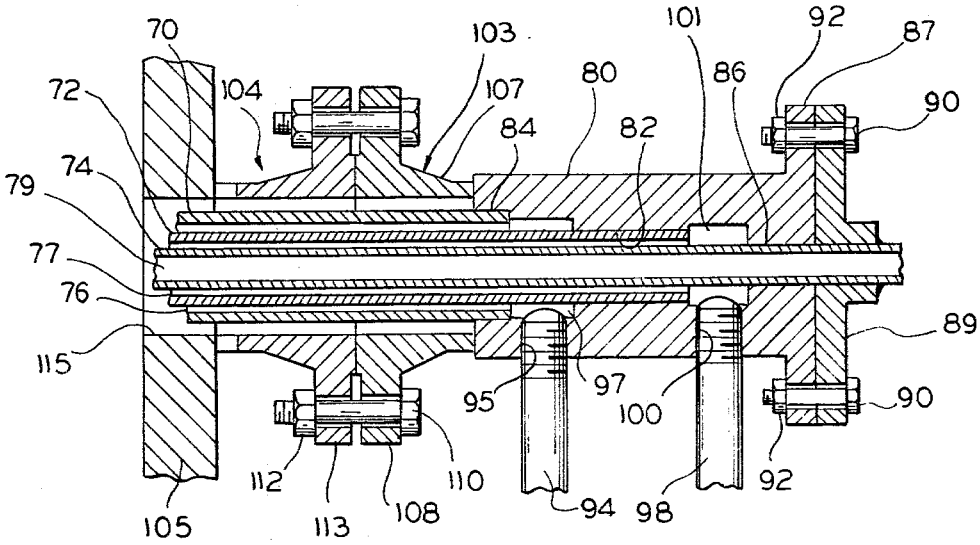
FIG. 4 illustrates one of the tuyeres employed in the vessel

The tuyeres 25 are shown in FIG. 4 to include three tuyere pipes 70, 72 and 74 arranged in a coaxial relation. The inner diameter of the outermost tuyere pipe 70 is larger than the outer diameter of the intermediate tuyere pipe 72 to define a first gap or tuyere passage 76 therebetween and the inner diameter of the intermediate pipe 72 is larger than the outer diameter of the innermost tuyere pipe 74 to defined a second gap or tuyere passage 77 therebetween. A third tuyere passage 79 is defined by the interior of the innermost tuyere pipe 74.

The tuyere pipes 70, 72 and 74 are mounted in spaced apart relation by means of a hollow, generally tubular tuyere pipe support body 80. As seen in FIG. 4, the body 80 is formed with a cylindrical bore 82 intermediate its ends and to which the outer end of the intermediate tuyere pipe 72 is secured in any suitable manner, such as by welding. At the vessel end of the body 80, a counter-bore 84 is formed for fixedly receiving the end of the outermost tuyere pipe 70. In this manner, the tuyere pipes 70 and 72 are affixed in spaced relation to form the gap 76. At the opposite end of the body 80, a concentric, smaller diameter opening 86 is formed for slidably receiving the innermost tuyere pipe 74 therethrough. In addition, a radially outwardly extending flange 87 is formed on the body 80 adjacent opening 86 for mating with a similarly configured radial flange 89 affixed to tuyere pipe 74. The flanges 87 and 89 may be secured in any suitable manner such as by bolts 90 and 92. This positions the innermost tuyere pipe 74 in spaced relation from the intermediate tuyere pipe 72 to define the gap 77 therebetween.

An external gas connection is provided to the tuyere passage 76 by means of a pipe 94 having a threaded end which is received in an internally threaded aperture 95 formed through body 80 adjacent the end of tuyere pipe 70. An annular groove 97 may also be formed in bore 82 and in an intersecting relation to the inner end of aperture 95. A similar external gas connection is provided to the tuyere passage 77 by means of a pipe 98 which is threaded into aperture 100 formed in body 80 adjacent the end of tuyere pipe 72 and an annular groove 101.

The tuyere assembly 23 may be supported on the vessel 10 in any suitable manner such as by means of a first mounting member 103 affixed to body 80, a second mounting member 104 affixed at one end to member 103 and at its other end to a mounting plate 105 which is secured to the vessel 10 by means (not shown). The first mounting member 103 includes a hollow body portion 107 which is affixed at one end of the vessel end of body 80 and in a concentric surrounding relation to the outer tuyere pipe 70. A radially extending flange 108 is integrally formed at the other end of body member 107 for being secured by bolts 110 and nut 112 to a similar flange 113 which extends integrally from one end of the hollow body member 104. The other end of the body 104 is secured in a concentric surrounding relation to an aperture 115 formed in plate 105. Aperture 115 is sized to receive tuyere 70 therethrough and the latter extends through vessel refractory 20 with the ends of pipes 70, 72 and 74 opening into vessel 10 and beneath the level of the metal therein.

The operation of the vessel according to the present invention will now be described. Initially, the vessel 10 is tilted to receive a metallic charge. Typically, a charge of solid material such as scrap iron, scrap steel, solid pig iron, iron oxide, or iron bearing materials in other solid form may be charged into the vessel after which a charge of liquid pig iron is added. Between the solid and liquid metallic charges, the solid charge may be preheated by tilting the vessel to its upright position and delivering a fuel, such as propane, natural gas or light oil, through the tuyere passage 76 and an oxygen containing gas through the tuyere passage 79. Nonoxidizing gas such as nitrogen or argon may be delivered to the inner tuyere passage 79. After the preheating step, the vessel is again tilted to receive the molten metal charge.

After charging has been completed, the vessel is returned to its upright position for the conversion process. During the periods of vessel turn up and turn down, a nonoxidizing gas such as nitrogen or argon is delivered through each of the three tuyere passages to prevent the back flow of molten metal. The hood 34 is normally in position above opening 33 when the vessel is in an unpivoted position and is elevated prior to pivotal movement of the vessel out of that position.

In the operation of a typical bottom blown converter vessel a desulfurizing agent is delivered in a powdered form to the vessel during the initial portion of the blowing cycle. Such desulfurizing agents generally comprise lime or a mixture of lime and fluorspar and are entrained in the gas delivered through the center pipe of two-pipe tuyeres normally employed in such vessels. If the desulfurizing agent is entrained in a carrier gas such as nitrogen or argon, the same gas is delivered through the outer tuyere pipe. On the other hand, if the desulfurizing agent is entrained in an oxygen stream, such prior art methods employ a hydrocarbon shielding fluid such as propane, natural gas or light oil through the outer tuyere pipe. After desulfurization, the main oxygen blow commences during which time oxygen is delivered through the central tuyere pipe and the hydrocarbon shielding fluid through the outer pipe. In addition, powdered lime may be entrained and the oxygen stream to facilitate phosphorous and silicon removal.

Because the powdered materials in such prior art methods were delivered through the central tuyere pipe which also carries pure oxygen during at least a portion of the process cycle, many desulfurizing agents which are highly oxidizable, such as magnesium powder, calcium carbide and calcium silicate, could not be employed because they tended to coat the linings of the gas delivery system and would thereby be present at times of oxygen delivery.

Figure 5:
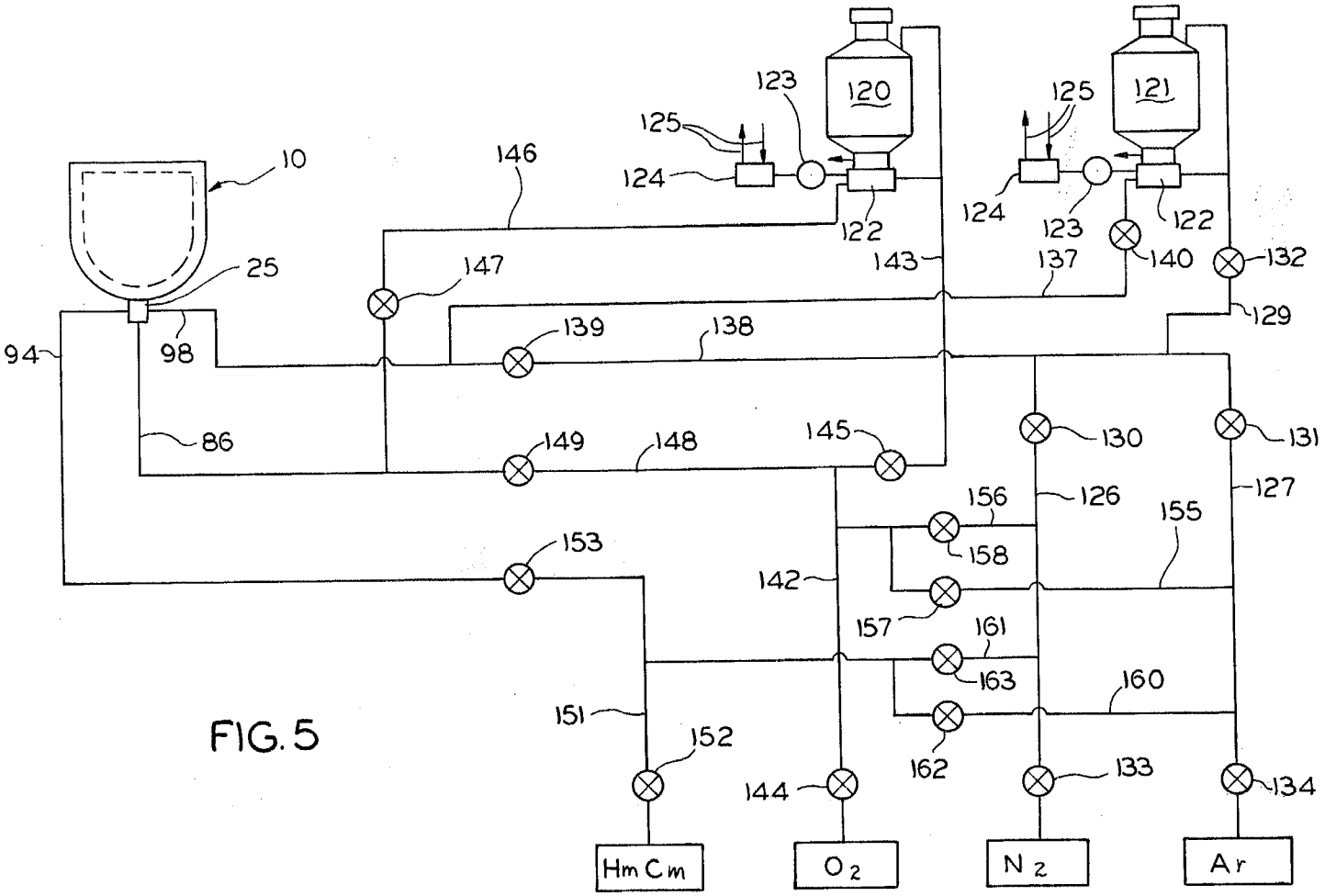
FIG. 5 schematically illustrates a flow control system for the vessel illustrated in FIGS. 1–3.

Reference is now made to FIG. 5 which schematically illustrates the flow control system for the materials delivered to the tuyres 25. Specifically, materials such as burnt lime, limestone, iron oxide, carbon, fluorspar or other agents compatible with oxygen are disposed in vessel 120 and desulfurizing agents, such as powdered magnesium, mixtures of powdered magnesium and lime, calcium carbide or calcium silicate are contained in pressure vessel 121. While only two vessels are shown, it will be understood that there may be as many pressure vessels as there are types of powdered materials which are to be injected into the molten metal within the vessel 10.

It will be appreciated that it is necessary to mix the powdered materials from a vessel such as 120 with entraining gas in a definite proportion. For this purpose, the bottom of each vessel 120 and 121 is provided with a mixing device 122, the details of which are not shown, but which are well known in the art. For example, the device 122 may be of the type which withdraws powdered material from its associated vessel and injects it into the gas stream. Each mixing device 122 may be operated by a motive means 123 having a controller 124 responsive to input signals from a control (not shown) as symbolized by arrows 125.

The mixing devices 122 are connected to as many sources of gas in which they may be delivered. As for example, the desulfurizing agents which are incompatible with oxygen and which are stored in vessel 121 are coupled by pipes 126, 127, 129 and valves 130, 131, 132, 133 and 134 to a source of nitrogen $N_2$ or argon Ar. The output of mixing chamber is also connected to the inlet pipe 98 of each tuyere by pipes 137 and 138 and valves 139 and 140. Similarly, the oxygen source $A_2$ may be coupled to the pressure vessel 120 by pipes 142 and 143 and valves 144 and 145 while pipe 146 and valve 147 connect the output of pressure vessel 120 to the center tuyere pipe 86. Oxygen may be delivered directly to center tuyere pipe 86 through pipes 142 and 148 and valves 144 and 149. Similarly, pipe 151 and valves 152 and 153 couple the hydrocarbon shielding fluid source identified by the symbol $H_mC_n$ to the tuyere inlet pipe 94. Nitrogen or argon may be coupled to the center tuyere pipe 86 by pipes 155 and 156 and valves 157 or 158, or to pipe 94 leading to the outer tuyere passage by means of pipes 160 or 161 or valves 162 or 163.

It will be appreciated by a proper setting of the valves 130, 131, 132, 133, 134, 139, 140, 144, 145, 149, 152, 153, 157, 158, 162, or 163, nitrogen or argon may be delivered to any of the tuyere passages, hydrocarbon shielding fluid may be delivered to the outer tuyere passage and oxygen may be delivered through the central tuyere passage. In addition, the powdered material in vessel 120 may be entrained in oxygen, nitrogen or argon and delivered to the center tuyere pipe 86 while the material in the vessel 121 may be entrained in nitrogen or argon and delivered to the intermediate tuyere passage.

In the illustrated apparatus, the system feeding the intermediate tuyere passages 77 are isolated from the oxygen feed system connected to the central tuyere passages 86. Accordingly, such desulfurizing agents as magnesium powdered, calcium carbonate, or calcium silicate can be entrained in a nonoxidizing gas such as nitrogen and argon and delivered to the central tuyere passages 77. During this time, a nonoxidizing gas may also be delivered through the other two tuyere passages. Alternatively, oxygen may be provided to the inner tuyere passage 79 and a hydrocarbon shielding fluid through the outer tuyere passage 76 thereby providing simultaneous deoxidation and desulfurization. Further, during periods when desulfurizing agents are not delivered through the central tuyere passage, nitrogen or argon will normally be provided to passage 77 to prevent the backflow of molten metal into the central passage. Further, if it is desired to adjust the carbon level of the metal bath at the end of the main blowing operation, powdered carbon can also be entrained in a nonoxidizing gas for delivery through the tuyere passages 77.

I claim:

1. A metallurgical vessel having concave upper and lower sections joined to form a hollow chamber, the inner surface of each of said sections having a pair of opposed, spaced apart end surfaces and a side surface connecting said end surfaces and which is arcuate in transverse cross-section, said upper section having a lower peripheral edge and said lower section having an upper peripheral edge in registry with the peripheral edge of said upper section, each said peripheral edge being defined by a pair of generally parallel side edges formed by the ends of said curved side surface and a pair of generally parallel end edges formed by said end surfaces, said sections being releasably secured and arranged with the side edges of the upper section being disposed adjacent and substantially equal in length to the end edges of the lower section and the end edges of the upper section being disposed adjacent and substantially equal in length to the side edges of the lower section, tuyere means extending through the lower section of said vessel for injecting process fluids below the level of molten metal therein, and means for rotating said vessel about an axis generally parallel to the axis of curvature of said lower section.

2. The vessel disclosed in claim 1 and including a tap hole formed in one end surface of said upper section and extending in a direction generally parallel to the tilt axis of said vessel.

3. The vessel set forth in claim 1 wherein said tuyere includes first and second spaced apart tuyere pipes to define first and second passages and a third tuyere pipe surrounding said second tuyere pipe and spaced therefrom to define a third tuyere passage.

4. The vessel set forth in claim 3 wherein there is a charging opening formed in said upper portion and having a major and a minor axis, the major axis of said charging opening being parallel to the tilt axis of the vessel.

5. The vessel set forth in claim 4 and including ring means surrounding said vessel and being generally concentric with the axis of curvature of said lower section, roller means for supporting said ring means, and means for rotating said vessel about the axis of said ring means.

6. A metallurgical vessel having an upper portion and a lower portion, said portions having interior surfaces each defining a semicylindrical section, said upper portion having a lower peripheral margin and said lower portion having an upper peripheral margin in registry with the margin of said upper portion to define an enclosed chamber, each peripheral margin having a first axis extending parallel to the axis of its cylindrical section and a second axis extending perpendicular thereto, said upper portion being oriented such that its first axis is generally perpendicular to the first axis of said lower portion so that said cylindrical sections are oriented at 90° one to the other, tuyere means extending through said lower portion for injecting process fluids below the level of molten metal in said vessels, means for rotating said vessel about an axis generally parallel to the axis of curvature of said lower section, a charging opening formed in said upper portion, the major axis of said charging opening being parallel to the axis of curvature of said lower section.

7. The vessel disclosed in claim 6 and including means for releasably securing said sections together with the margins of said interior surfaces in registry.

8. The vessel set forth in claim 7 wherein said tuyere means includes a plurality of tuyeres having a first tuyere pipe defining a first tuyere passage, a second tuyere pipe surrounding the first tuyere pipe in spaced relation therefrom to define a second tuyere passage, and a third tuyere pipe surrounding said second tuyere pipe and spaced therefrom to define a third tuyere passage.

9. The vessel set forth in claim 8 and including ring means surrounding said vessel and being generally concentric with the axis of curvature of said lower section, roller means for supporting said ring means, and means for rotating said vessel about the axis of said ring means.

* * * * *